US009504311B2

(12) United States Patent
Putzer

(10) Patent No.: US 9,504,311 B2
(45) Date of Patent: Nov. 29, 2016

(54) HAIRBRUSH DEVICE HAVING A VARIABLE STIFFNESS OF BRUSH FILAMENTS

(75) Inventor: Arthur Putzer, Bad Eisenkappel (AT)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 92 days.

(21) Appl. No.: 13/982,833

(22) PCT Filed: Feb. 2, 2012

(86) PCT No.: PCT/IB2012/050486

§ 371 (c)(1),
(2), (4) Date: Nov. 11, 2013

(87) PCT Pub. No.: WO2012/104807

PCT Pub. Date: Aug. 9, 2012

(65) Prior Publication Data

US 2014/0311510 A1 Oct. 23, 2014

(30) Foreign Application Priority Data

Feb. 3, 2011 (EP) ..... 11153150

(51) Int. Cl.
*A46B 9/10* (2006.01)
*A46B 9/02* (2006.01)
(Continued)

(52) U.S. Cl.
CPC ..... *A46B 9/023* (2013.01); *A45D 2/00* (2013.01); *A45D 20/00* (2013.01); *A46B 7/023* (2013.01); *A46B 9/10* (2013.01)

(58) Field of Classification Search
CPC .... A46B 5/0008; A46B 5/0054; A46B 7/06; A46B 7/023; A46B 13/001; A46B 9/023; A46B 9/10; A46B 9/02; A46B 9/026; A46B 9/021; A46B 2200/104; A46B 2200/1093; A45D 20/00; A45D 2/00
USPC ..... 132/123, 212, 216, 218, 119.1, 120, 132/121, 122, 124–127, 135–137, 139, 140, 132/141, 142, 150–155, 163, 237, 238, 132/223; 15/22.2, 23, 33, 34, 106, 201, 15/172, 27; 401/127, 129
See application file for complete search history.

(56) References Cited

U.S. PATENT DOCUMENTS 1,766,140 A * 6/1930 Narducci ..... 15/23
2,473,227 A * 6/1949 Solomon ..... 132/120
(Continued)

FOREIGN PATENT DOCUMENTS

DE 3223560 A1 12/1983
JP 39014786 A 7/1939
(Continued)

OTHER PUBLICATIONS 1. http://www.hunterlab.com/Instruments/Bench/UltraScanVIS.

*Primary Examiner* — Rachel Steitz

(57) ABSTRACT

A hairbrush device (100) comprises a first plurality of brush filaments (112) and a second plurality of brush filaments (116). A property of the first plurality of brush filaments (112) and a respective property of the second plurality of brush filaments (116) are different from one another. In order to reversibly select a stiffness of the hairbrush device, the hairbrush device (100) comprises an actuation element (104) being in driving connection with the first and second plurality of brush filaments (11, 116) and configured for being actuatable for selecting the first plurality of brush filaments (112) or the second plurality of brush filaments (116) for a use.

10 Claims, 2 Drawing Sheets

(51) Int. Cl.

| | |
|---|---|
| ***A46B 7/02*** | (2006.01) |
| ***A45D 2/00*** | (2006.01) |
| ***A45D 20/00*** | (2006.01) |

(56) References Cited

U.S. PATENT DOCUMENTS

| | | | | |
|---|---|---|---|---|
| 2,496,010 | A * | 1/1950 | Lotters | 15/201 |
| 2,827,646 | A * | 3/1958 | Hoffman | 15/25 |
| 3,232,301 | A | 2/1966 | Bolinger | |
| 3,474,795 | A * | 10/1969 | Lutz et al. | 132/119.1 |
| 3,962,742 | A * | 6/1976 | Vendur | 15/201 |
| 4,014,064 | A * | 3/1977 | Okazaki | 15/207.2 |
| 4,192,326 | A * | 3/1980 | Klinge | 132/238 |
| 4,214,340 | A * | 7/1980 | Youngberg et al. | 15/184 |
| 4,250,902 | A | 2/1981 | Ihara | |
| 4,473,086 | A | 9/1984 | Thaler | |
| 4,944,319 | A * | 7/1990 | Trombley | 132/238 |
| 5,027,838 | A | 7/1991 | Iaia | |
| 5,337,765 | A * | 8/1994 | Wong | 132/120 |
| 5,427,120 | A | 6/1995 | Wong | |
| 5,584,088 | A * | 12/1996 | Pauldine | 15/27 |
| 5,979,463 | A * | 11/1999 | Santy et al. | 132/120 |
| 6,070,594 | A | 6/2000 | Mears | |
| 6,098,635 | A * | 8/2000 | Marino | 132/238 |
| 6,308,717 | B1 * | 10/2001 | Vrtaric | 132/200 |
| 6,341,611 | B1 * | 1/2002 | Nakamura | 132/120 |
| 7,320,148 | B1 | 1/2008 | Willette | |
| 7,712,176 | B2 * | 5/2010 | Guenin | 15/160 |
| 7,814,602 | B2 * | 10/2010 | Stydahar | 15/22.3 |
| 8,573,231 | B2 * | 11/2013 | Ragosta et al. | 132/119.1 |
| 2002/0066150 | A1 * | 6/2002 | Bigio | 15/160 |
| 2009/0065020 | A1 * | 3/2009 | Butcher et al. | 132/218 |
| 2009/0272393 | A1 * | 11/2009 | Stydahar | 132/200 |
| 2011/0056505 | A1 * | 3/2011 | Parkinson et al. | 132/120 |
| 2011/0162669 | A1 * | 7/2011 | Kurek et al. | 132/200 |
| 2011/0297174 | A1 * | 12/2011 | Ornoski et al. | 132/218 |
| 2014/0190509 | A1 * | 7/2014 | Coba | 132/212 |

FOREIGN PATENT DOCUMENTS

| | | | |
|---|---|---|---|
| JP | 62144603 | A | 6/1987 |
| WO | 0115510 | A2 | 3/2001 |
| WO | 2007120223 | A1 | 10/2007 |

* cited by examiner

HAIRBRUSH DEVICE HAVING A VARIABLE STIFFNESS OF BRUSH FILAMENTS

FIELD OF THE INVENTION

The invention relates to the field of hairbrush devices, and in particular to a hairbrush device, a hair drying apparatus, and a hair curling apparatus.

BACKGROUND OF THE INVENTION

When styling hair, a user uses a hairbrush device. Such a hairbrush device conventionally comprises a filament carrier to which a plurality of brush filaments are fixed.

The plurality of brush filaments may be manufactured using different materials, for example, horse hair, nylon, and plastic, and may comprise different dimensions in terms of a thickness and a length of the plurality of brush filaments. The material, the dimensions, and a number of the plurality of brush filaments may influence a stiffness of the plurality of brush filaments and thus characterize the hairbrush device for different styling applications.

Users may use hairbrush devices comprising different stiffnesses of the plurality of brush filaments, in order to achieve different styling effects of the hair.

Accordingly, it may be desirable to selectively adjust a stiffness of the plurality of brush filaments of a hairbrush such that the hairbrush device is usable for different styling applications.

U.S. Pat. No. 6,070,594 describes a hairbrush device comprising a tubular base body in which a plurality of filament carriers is accommodated. A plurality of brush filaments is attached to each of the plurality of filament carriers and extends through apertures formed in the tubular base body. The plurality of brush filaments are retractable into the tubular base body of the hairbrush device. To this end, the plurality of filament carriers is rotatable around a longitudinal axis of the hairbrush device.

A user of the hairbrush device may unintentionally leave the plurality of brush filaments (partially) retracted in the tubular base body, thereby leading to a changed stiffness of the plurality of brush filaments of the hairbrush device. However, this change of the stiffness of the plurality of brush filaments may irreversibly modify the characteristics of the hairbrush device, thereby turning the hairbrush device being not usable any more.

SUMMARY OF THE INVENTION

It may be an object of the present invention to provide a hairbrush device, a hair drying apparatus and a hair curling apparatus which may be usable for various hair styling applications.

The object defined above is solved by a hairbrush device, a hair drying apparatus, and a hair curling apparatus according to the independent claims.

According to an exemplary aspect of the invention, a hairbrush device is provided, the hairbrush device comprising a first plurality of brush filaments, a second plurality of brush filaments, wherein a property of the first plurality of brush filaments and a respective property of the second plurality of brush filaments are different from one another, and an actuation element being in driving connection with the first and second plurality of brush filaments and configured for being actuatable for selecting the first plurality of brush filaments or the second plurality of brush filaments for a use.

According to another exemplary aspect of the invention, a hair drying apparatus configured for drying hair is provided, the hair drying apparatus comprising a hairbrush device as described above.

According to another exemplary aspect of the invention, a hair curling apparatus configured for curling hair is provided, the hair curling apparatus comprising a hairbrush device as described above.

According to the exemplary aspects of the invention, a hairbrush device may be provided which may comprise a selectable stiffness of its plurality of brush filaments. To this end, either the first plurality of brush filaments may be selected to be used by a user for styling the hair or alternatively the second plurality of brush filaments may be selected for the use such that, depending on the selected plurality of brush filaments, the hairbrush device may comprise a first stiffness or a second stiffness of its plurality of brush filaments.

In particular, an application area of the hairbrush device may be increased, since the hairbrush device may comprise a variable stiffness of its usable plurality of brush filaments and thus may be utilized for accomplishing various hair styling effects.

In particular, the hairbrush device may be easily handable by a user of the hairbrush device, since the user may actuate the actuation element of the hair brush device for the selection of the first or second plurality of brush filaments.

In particular, the stiffness of the used plurality of brush filaments may be reversibly selectable, such that damages of the hairbrush device associated with the variable stiffness of the plurality of brush filaments may be avoided as may be known from the known hairbrush device.

Next further exemplary embodiments of the hairbrush device will be explained. However, these embodiments also apply to the hair drying apparatus and the hair curling apparatus.

In particular, a brush filament may comprise one or more bristles.

The hairbrush device may further comprise a filament carrier, wherein the first and second pluralities of brush filaments may be connected to the filament carrier, wherein the actuation element may be in driving connection with the filament carrier such that the filament carrier may be rotatable along a longitudinal axis of the filament carrier between a first position associated with the first plurality of brush filaments being selected for the use and a second position associated with the second plurality of brush filaments being selected for the use. Accordingly, the selection of the first and second plurality of brush filaments may be based on rotating the filament carrier between the first position and the second position, whereby the hairbrush device may comprise a constructively simple and compact design with a low number of components despite its selectable stiffness of the hair brush device.

The actuation element may be configured as a tube-like rotating wheel particularly having grooves for facilitating a user gripping the rotating wheel.

The hairbrush device may further comprise a gearwheel comprising an external toothing (particularly formed on an outer surface of the gearwheel), wherein the gearwheel may be connected to the filament carrier in a rotationally fixed way, wherein the external toothing of the gearwheel may be engaged with an internal toothing of the actuation element (particularly formed on an inner surface of the actuation element). In particular, a transverse front side of the gearwheel may be connected to a front side of the gearwheel. In particular, the gearwheel may be fixed to the filament carrier using an adhesive or by welding the gearwheel and the filament carrier to one another. This measure may represent a constructively simple technique for providing a rotationally based driving connection between the actuation element and the filament carrier.

The hairbrush device may further comprise a handle connected to the actuation element in a rotationally movable way, and a fixing element connected to the handle in a rotationally fixed way and configured for being detachably engageable with the actuation element for rotationally fixing the actuation element relative to the handle (in a detachably way). Accordingly, the hairbrush device may comprise a locking mechanism such that the actuation element may be rotationally stationary with respect to the handle during the use of the hair brush device but may be rotationally movable when being actuated for the selection of the first or second plurality of brush filaments. Since the filament carrier may be in driving connection with the actuation element, the locking mechanism may also prevent a rotational movement of the filament carrier and the selected first or second plurality of brush filaments when using the hairbrush device and may allow for rotating the filament carrier when selecting the first or second plurality of brush filaments for its use.

The actuation element may comprise first and second recesses configured for at least partially accommodating the fixing element. In particular, when actuating the actuation element the fixing element may be forced to disengage from the first and/or second recesses, and, subsequent to a movement of the actuation element, the fixing element may be forced to engage into the first/or second recesses. Thus, this measure may provide a cost-effective and simple technique for providing a detachable locking mechanism for rotationally fixing the actuation element relative to the handle such that the selection of the first or second plurality of brush filaments may not be unintentionally altered during the use of the hair brush device.

In particular, the fixing element may comprise one member, and the first plurality of brush filaments being selected for the use may be associated with the fixing element being at least partially accommodated in the first recess, and the second plurality of brush filaments being selected for the use may be associated with the fixing element being at least partially accommodated in the second recess. Thus, the locking mechanism may be cost-effective, since only few components may be required.

In particular, the fixing element may comprise two (particularly identical) members, and the first plurality of brush filaments being selected for the use may be associated with the first member of the fixing element being at least partially accommodated in the first recess and the second member may be at least partially accommodated in the second recess, and the second plurality of brush filaments being selected for the use may be associated with the first member of the fixing element being at least partially accommodated in the second recess and the second member may be at least partially accommodated in the first recess. Thus, a mechanical stable locking mechanism for the hairbrush device may be provided.

In particular, the first and second recesses may be formed in (particularly the front side of) the actuation element at diametrically opposite locations.

In particular, the (members of the) fixing element may comprise a spring-loaded ball or a push rod. These conventional measures for the fixing element may be easily implementable into the hairbrush device without requiring constructive modifications of an outer appearance of the hairbrush device, since such a fixing element may represent a space-saving component being easily integratable into the hairbrush device.

The hairbrush device may further comprise a tubular base body comprising a plurality of apertures (particularly formed in the tubular base body), wherein the first plurality of brush filaments being selected for the use may be associated with the first plurality of brush filaments extending through the plurality of apertures, and wherein the second plurality of brush filaments being selected for the use may be associated with the second plurality of brush filaments extending through the plurality of apertures. Accordingly, the tubular base body may protect the filament carrier against damages and a connection point between the first and second plurality of brush filaments and the filament carrier, and may allow for exposing either the first plurality of brush filaments or the second plurality of brush filaments to an environment such that the first plurality of brush filaments or the second plurality of brush filaments may be selected for its use.

In particular, each of the plurality of apertures may extend transversely, particularly perpendicularly, to a longitudinal axis of the tubular base body and/or may be configured as elongated holes, thereby providing enough space for rotationally exposing or rotationally retracting the first and second plurality of brush filaments into the tubular base body without unnecessarily bending or damaging the plurality of brush filaments.

In particular, the handle may be rotationally fixed to the tubular base body such that the relative arrangement of the first and second plurality of brush filaments and the handle may be rotationally stationary during the use of the hairbrush device, thereby facilitating the use of the hairbrush device.

In particular, the filament carrier may extend parallel to or along the longitudinal axis of the tubular base body, thereby preventing any canting of the filament carrier in the tubular base body during the selection of the first and second plurality of brush filaments of the hair brush device.

The first plurality of brush filaments and the second plurality of brush filaments may be arranged in rows (particularly extending along a longitudinal extension of the filament carrier) which may be distributed along a circumferential direction of the filament carrier with respect to a longitudinal extension of the filament carrier. Thus, by arranging the first and second plurality of brush filaments in spatially separated rows, the plurality of brush filaments may be easily selectable by rotating the filament carrier along its longitudinal axis through a suitable rotation angle.

The filament carrier may comprise an elongated body, wherein the elongated body may comprise first and second opposing sides, wherein the first plurality of brush filaments may be arranged at the first side, and wherein the second plurality of brush filaments may be arranged at the second side. In particular, the filament carrier may comprise a rectangular cuboid shape, wherein the first and second plurality of brush filaments may be arranged at the opposing longitudinal sides of the filament carrier. In particular, the width of the longitudinal side may be smaller compared to another width of the other longitudinal sides. Accordingly, the first and second plurality of brush filaments may be selectable by rotating the filament carrier by an angle of approximately 180°. Thus, an inner space of the tubular base body may be used in an optimal way. In particular, by designing the filament carrier with a rectangular cross-section, a weight of the hairbrush device may be particularly low, thereby facilitating a use of the hairbrush device.

The property may comprise at least one of a number of the plurality of brush filaments, an arrangement of the plurality of brush filaments along the hairbrush, a color of the plurality of brush filaments, a length of the plurality of brush filaments, a thickness of the plurality of brush filaments, and a material of the plurality of brush filaments. In particular, these properties of the plurality of brush filaments may influence the stiffness of the plurality of brush filaments and thus of the hairbrush device. In particular, using different colors for the first and second plurality of brush filaments, color-coded information for a user of the hairbrush device may be provided, in order to facilitate the selection of the plurality of brush filaments and to allow a user to identify the selected first and second plurality of brush filaments.

In particular, the greater a length of the plurality of brush filaments may be, the smaller the stiffness of the plurality of brush filaments may be. In particular, the smaller a thickness of the plurality of brush filaments may be, the smaller the stiffness of the plurality of brush filaments may be. In particular, the lower the number of the plurality of brush filaments may be, the lower the stiffness of the hair brush experienced by the user of the hairbrush device may be.

In particular, the first plurality of brush filaments may comprise a blue color, and the second plurality of brush filaments may comprise a black color.

In particular, the material of the plurality of brush filaments may comprise plastic, nylon and horse hair.

In particular, the first plurality of brush filaments may comprise a nylon material, and the second plurality of brush filaments may comprise a horse hair material.

The hairbrush device may further comprise a plurality of filament carriers, wherein the first and second plurality of brush filaments may be connected to the plurality of filament carriers, wherein the actuation element may be in driving connection with the plurality of filament carriers such that the plurality of filament carriers may be rotatable along longitudinal axes of the plurality of filament carriers between first positions associated with the first plurality of brush filaments being selected for the use and second positions associated with the second plurality of brush filaments being selected for the use. In particular, the plurality of filament carriers may be arranged along a circumference of the actuation element particularly at diametrically opposing locations. Accordingly, a user of the hair brush device may not need to pay attention to the relative arrangement of the hairbrush device and the hair to be styled, thereby facilitating the use of the hair brush device.

In particular, each of the first and second positions of the plurality of filament carriers may be defined by respective rotation angles of the plurality of filament carriers.

The hairbrush device may further comprise at least another plurality of brush filaments, wherein the property of the first plurality of brush filaments, the respective property of the second plurality of brush filaments, and a respective property of the at least another plurality of brush filaments may be different to one another, wherein the actuation element may be in driving connection with the at least another plurality of brush filaments and may be configured for being actuatable for selecting the first plurality of brush filaments, the second plurality of brush filaments or the at least another plurality of brush filaments for the use. Thus, the hair brush device may comprise at least another stiffness value of its usable plurality of brush filaments, such that the application area of the hair brush device may be further enlarged. In particular, the filament carrier may comprise a triangular cross-section, wherein the first plurality of brush filaments may be arranged at a first longitudinal side of the filament carrier, the second plurality of brush filaments may be arranged at another longitudinal side of the filament carrier, and the another plurality of filament carriers may be arranged at the remaining longitudinal side of the filament carrier.

Next further exemplary embodiments of the hair drying apparatus will be explained. However, these embodiments also apply to the hairbrush device and the hair curling apparatus.

In particular, the hairbrush device may form a top part for the hair drying apparatus.

In particular, the filament carrier and/or the tubular base body may comprise a plurality of through holes through which cold and/or heated air is feedable for drying the hair. In particular, the plurality of through holes of the tubular base body may be identical to the plurality of apertures.

In particular, the hair drying apparatus may not comprise a handle but a connection element configured for connecting the hairbrush device to a base part of the hair drying apparatus. In particular, the fixing element may be connected to (particularly a front side of) the connection element (particularly with the front side of the connection element facing the front side of the actuation element).

Next further exemplary embodiments of the hair curling apparatus will be explained. However, these embodiments also apply to the hairbrush device and the hair drying apparatus.

In particular, the hairbrush device may form a top part for the hair curling apparatus.

In particular, the filament carrier and/or the tubular base body may comprise a heat conductive material such that heat is transferable to the hair via the filament carrier and/or the tubular base body.

In particular, the hair curling apparatus may not comprise a handle but a connection element configured for connecting the hairbrush device to a base part of the hair drying apparatus. In particular, the fixing element may be connected to (particularly a front side of) the connection element (particularly with the front side of the connection element facing the front side of the actuation element).

BRIEF DESCRIPTION OF THE DRAWINGS

The invention will be described in more detail hereinafter with reference to examples of embodiment but to which the invention is not limited.

DETAILED DESCRIPTION OF EMBODIMENTS

Figure 1:
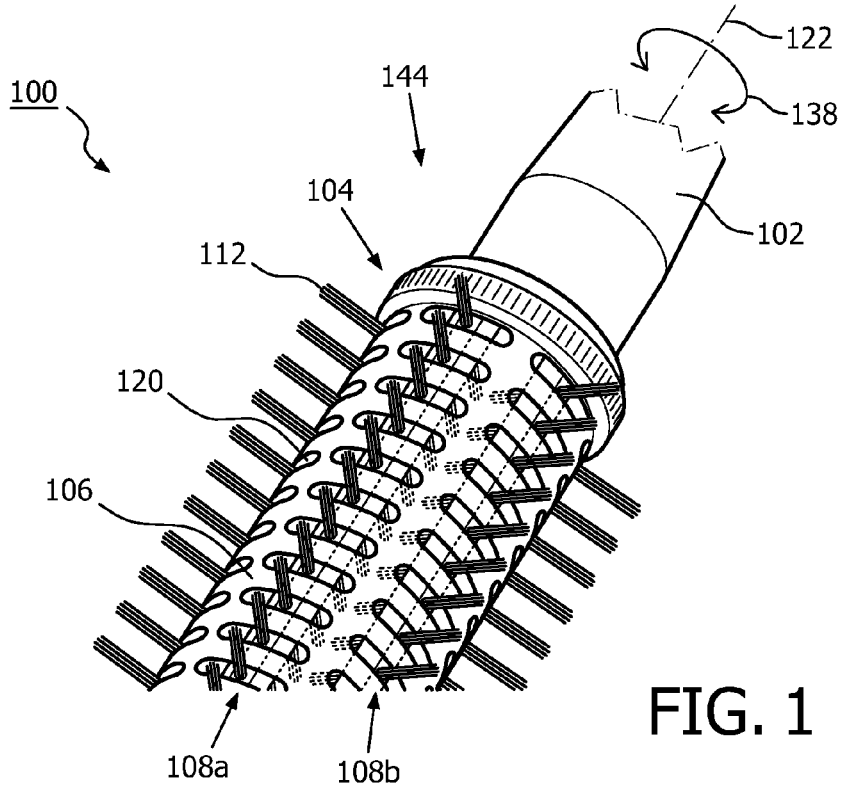
FIG. 1 shows a perspective partial view of a hairbrush device according to an exemplary embodiment of the invention in a first position of the hairbrush device.

The illustration in the drawing is schematic. It is noted that in different figures, similar or identical elements are provided with the same reference signs or with reference signs, which are different from the respective reference signs only with a first digit.

Figure 2:
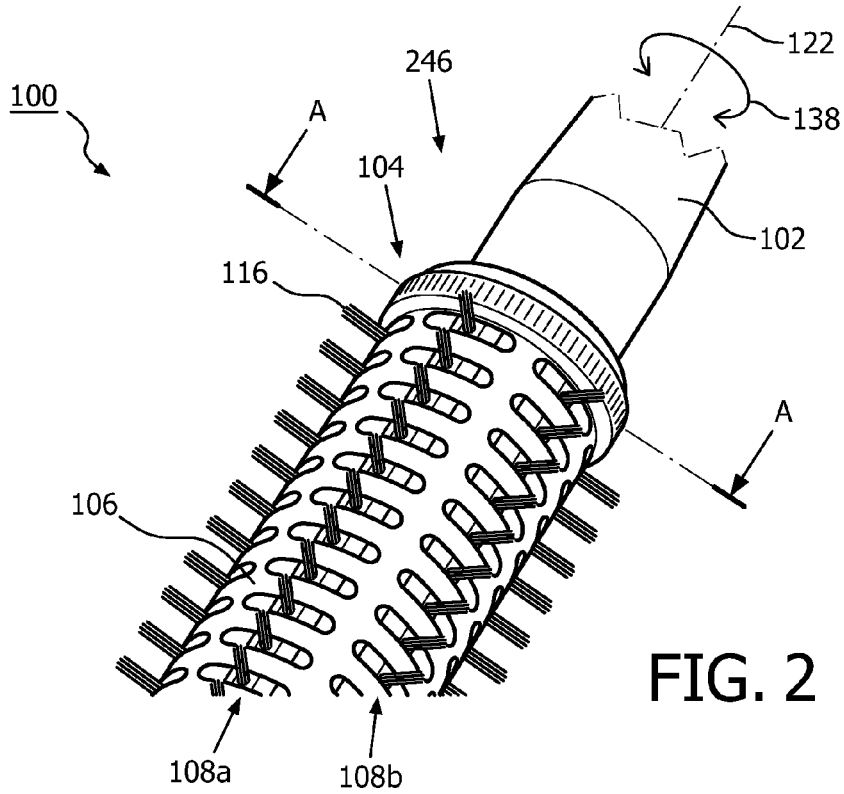
FIG. 2 shows another perspective partial view of the hairbrush device in FIG. 1 in a second position of the hair brush device.
Figure 3:
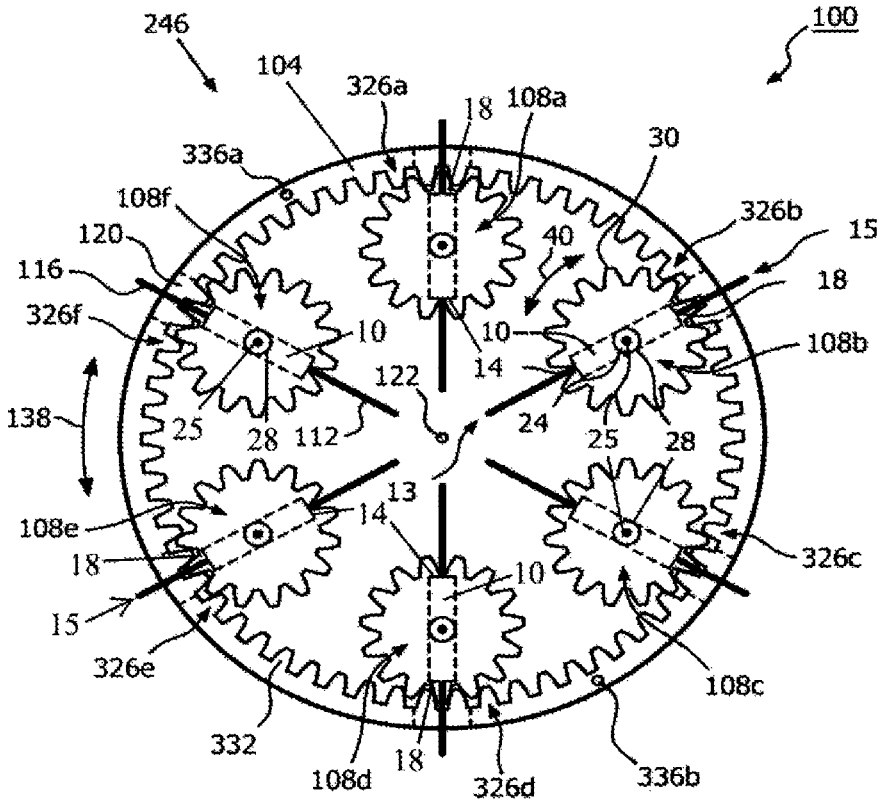
FIG. 3 shows a cross-sectional view of the hairbrush device in FIG. 1, taken along a line A-A in FIG. 2.

Referring to FIGS. 1-3, a hairbrush device 100 according to an exemplary embodiment of the invention is illustrated. The hairbrush device 100 comprises a handle 102, an actuation element 104 in the form of a rotating wheel, a tubular base body 106, and six filament carriers 108*a-f*.

Each of the filament carriers 108*a-f* comprises a rectangular cuboid shaped body 10 having an extension of about 100 millimeters (mm), a thickness of about 2 mm to about 5 mm and a height of 10 mm (FIG. 3). A first plurality of brush filaments 112 are arranged in rows 13 on first longitudinal sides 1 of the six filament carriers 108*a-f* and have the smaller thickness. A second plurality of brush filaments 116 are arranged in rows 15 on second longitudinal sides 18 of the six filament carriers 108*a-f* which are opposite to the longitudinal sides 14. Each of the first plurality of brush filaments 112 is made from horse hair and has a length of 12 mm and a diameter of 0.1 mm, and each of the second plurality of brush filaments 116 is made of a nylon material and has a length of 7 mm and a diameter of 0.3 mm. The first plurality of brush filaments 112 has a blue color, and the second plurality of brush filaments 116 has a black color. To simplify illustration, many identical components shown in FIG. 3 are assigned identical reference numerals.

The tubular base body 106 comprises a plurality of apertures 120 which extend vertically to a longitudinal axis 122 of the tubular base body 106 of the hairbrush device 100. Each of the plurality of apertures 120 is designed as an elongated hole through which the first or second plurality of brush filaments 112, 116 extend.

The actuation element 104 is two-directionally rotatable around the longitudinal axis 122.

Each of the filament carriers 108*a-f* is mounted to the handle 102 via bearing pins 24 in a two-directional rotationally movable way and is rotationally movable around a respective longitudinal axis 25 (FIG. 3). Each of the longitudinal axes 25 runs parallel to the longitudinal axis 122 of the hairbrush device 100.

Each of the filament carriers 108*a-f* is welded to a respective gearwheel 326*a-f* having an inner opening 28 through which the bearing pin 24 extends to be connected to the handle 102. Further, the gearwheels 326*a-f* comprise external teeth 30 formed on outer surfaces of the gearwheels 326*a-f*. The actuation element 104 comprises internal teeth 332 which is formed on an inner surface of the actuation element 104 and which engages with the external teeth 30 of the gearwheels 326*a-f*.

Further, the hairbrush device 100 comprises a locking mechanism formed by a fixing element in the form of a spring-loaded ball (not visible) rotationally fixed to the handle 102 and respective first and second recesses 336*a*, 336*b* formed at a front surface of the actuation element 104 facing the handle 102. The first and second recesses 336*a, b* are arranged at diametrically opposing positions along a circumference of the actuation element 104.

In operation of the hairbrush device 100, a user of the hairbrush device 100 actuates the actuation element 104 by rotating the actuation element 104 around the longitudinal axis 122 of the hairbrush device 100 in directions indicated by an arrow 138. Accordingly, the internal teeth 332 of the actuation element 104 and the external teeth of the gearwheels 326*a-f* roll relative to one another such that the gearwheels 326*a-f* rotate around their rotational axes 25. Since the gearwheels 326*a-f* are attached to the filament carriers 108*a-f*, each of the filament carriers 108*a-f* is rotated around its respective rotational axis 25 as indicated by arrows 40 until the fixing element connected to the handle 102 engages with one of the first and second recesses 336*a, b* formed in the actuation element 104. When the fixing element is in engagement with the respective one of the first or second recesses 336*a, b*, either the first plurality of brush filaments 112 or the second plurality of brush filaments 116 extend through the plurality of apertures 120 formed in the tubular base body 106.

FIG. 1 shows the hairbrush device 100 in a first position 144, in which the first plurality of brush filaments 112 extends through the plurality of apertures 120 of the tubular base body 106 and is thus selected for a use. In the first position 144 of the hairbrush device 100, the filament carriers 108*a-f* are rotated by angles of 0 degree (°), 60°, 120°, 180°, 240°, 300°, and 360° equaling to 0° measured with respect to a common coordination system. FIG. 2 shows a second position 246 of the hairbrush device 100, in which the second plurality of brush filaments 116 extends through the plurality of apertures 120 of the tubular base body 106 and is thus selected for the use. In the second position 246 of the hairbrush device 100, the filament carriers 108*a-f* are rotated by angles of 180°, 240°, 300°, 360° equaling to 0°, 420° equaling to 60°, 480° equaling to 120°, and 540° equaling to 180° measured with respect the common coordination system.

While the invention has been illustrated and described in detail in the drawings and foregoing description, such illustration and description are to be considered illustrative or exemplary and not restrictive; the invention is not limited to the disclosed embodiments. Other variations to the disclosed embodiments can be understood and effected by those skilled in the art in practicing the claimed invention, from a study of the drawings, the disclosure, and the appended claims. In the claims, the word "comprising" does not exclude other elements or steps, and the use of the indefinite article "a" or "an" does not exclude a plurality. The mere fact that certain measures are recited in mutually different dependent claims does not indicate that a combination of these measures cannot be used to advantage. Any reference signs in the claims should not be construed as limiting the scope.

The invention claimed is:

1. A hairbrush device comprising:

a first plurality of brush filaments; and a second plurality of brush filaments;

where the first and second pluralities of brush filaments have different properties from one another and are adapted to be selectively actuated for use;

an actuation element in driving connection with the first and second plurality of brush filaments and configured to effect selective actuation of the first plurality of brush filaments or the second plurality of brush filaments for use; and a filament carrier to which the first and second pluralities of brush filaments are connected, said actuation element being in driving connection with the filament carrier such that the filament carrier is rotatable around a central axis of the filament carrier between a first position associated with the first plurality of brush filaments being selected for use and a second position associated with the second plurality of brush filaments being selected for use.

2. The hairbrush device according to claim 1 comprising a gearwheel affixed to the filament carrier for rotation around the central axis of the filament carrier and including radially outwardly extending teeth relative to said central axis, said actuation element being rotatable around a longitudinal axis thereof and including radially inwardly extending teeth relative to said longitudinal axis for engaging with said radially outwardly extending teeth of said gearwheel.

3. A hairbrush device comprising:

a first plurality of brush filaments; and a second plurality of brush filaments;

where the first and second pluralities of brush filaments have different properties from one another and are adapted to be selectively actuated for use; and an actuation element in driving connection with the first and second plurality of brush filaments and configured to effect selective actuation of the first plurality of brush filaments or the second plurality of brush filaments for use; and a handle connected to the actuation element in a rotationally movable way.

4. The hairbrush device according to claim 3, where the actuation element comprises first and second recesses configured for cooperating with the handle to secure said actuation element in either a first or a second rotational position relative to the handle to effect said selection of either the first plurality of brush filaments or the second plurality of brush elements, respectively.

5. A hairbrush device comprising:

a first plurality of brush filaments; and a second plurality of brush filaments;

where the first and second pluralities of brush filaments have different properties from one another and are adapted to be selectively actuated for use; and an actuation element in driving connection with the first and second plurality of brush filaments and configured to effect selective actuation of the first plurality of brush filaments or the second plurality of brush filaments for use; and a plurality of filaments carriers to which respective pairs of the first and second pluralities of brush filaments are connected, said actuation element being in driving connection with the plurality of filament carriers such that the plurality of filament carriers are each rotatable around a respective central axis between a first position associated with the first plurality of brush filaments being selected for use and a second position associated with the second plurality of brush filaments being selected for use.

6. The hairbrush device according to claim 5 where the central axes of the filament carriers are arranged around a common central longitudinal axis and, when positioned for use, the first plurality of brush filaments and the second plurality of brush filaments are arranged in radially extending rows relative to the longitudinal axis.

7. The hairbrush device according to claim 5 where the different properties of the first and second pluralities of brush filaments include at least one of:

different arrangements of the brush filaments, different colors of the brush filaments, different lengths of the brush filaments, different thicknesses of the brush filaments, and different materials of the brush filaments.

8. A hairbrush device comprising:

a first plurality of brush filaments; and a second plurality of brush filaments;

where the first and second pluralities of brush filaments have different properties from one another and are adapted to be selectively actuated for use; and an actuation element in driving connection with the first and second plurality of brush filaments and configured to effect selective actuation of the first plurality of brush filaments or the second plurality of brush filaments for use; and a tubular base body including a plurality of apertures, said selective actuation of the first plurality of brush filaments being associated with the first plurality of brush filaments extending through the plurality of apertures, and said selective actuation of the second plurality of brush filaments being associated with the second plurality of brush filaments extending through the plurality of apertures.

9. The hairbrush device according to claim 3 and comprising a filament carrier having an elongated body with first and second opposing sides, the first plurality of brush filaments being arranged at the first side and the second plurality of brush filaments being arranged at the second side.

10. A hairbrush device comprising:

a tubular housing having a plurality of apertures therein;

at least one filament carrier rotatably supported within the tubular housing and having first and second portions holding respective first and second pluralities of filaments, a property of the first plurality of filaments being different than a property of the second plurality of filaments; and an actuation element coupled to the at least one filament carrier and adapted to selectively rotate said filament carrier to either:

a first position where the first plurality of filaments extend through respective ones of the plurality of apertures in the housing; or a second position where the second plurality of filaments extend through respective ones of the plurality of apertures in the housing.

* * * * *